US009725281B2

(12) United States Patent
Fargo et al.

(10) Patent No.: US 9,725,281 B2
(45) Date of Patent: Aug. 8, 2017

(54) ELEVATOR ROLLER GUIDE

(75) Inventors: Richard N. Fargo, Plainville, CT (US); John T. Pitts, Avon, CT (US); James L. Hubbard, Kensington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 138 days.

(21) Appl. No.: 14/238,855

(22) PCT Filed: Aug. 24, 2011

(86) PCT No.: PCT/US2011/048916

§ 371 (c)(1),
(2), (4) Date: Feb. 14, 2014

(87) PCT Pub. No.: WO2013/028184

PCT Pub. Date: Feb. 28, 2013

(65) Prior Publication Data

US 2015/0298938 A1 Oct. 22, 2015

(51) Int. Cl.

| | |
|---|---|
| ***B66B 7/04*** | (2006.01) |
| ***B66B 11/02*** | (2006.01) |
| ***B66B 7/02*** | (2006.01) |

(52) U.S. Cl.

CPC ..... *B66B 7/046* (2013.01); *B66B 7/02* (2013.01); *B66B 11/02* (2013.01)

(58) Field of Classification Search

CPC B66B 7/04; B66B 7/042; B66B 7/046; B66B 7/047; B66B 7/041; B66B 7/043; B66B 7/044; B66B 7/045; B66B 7/048

(Continued)

(56) References Cited

U.S. PATENT DOCUMENTS 1,485,302 A * 2/1924 Sharp ..... B66B 7/047 187/409
1,854,976 A 4/1932 Brady (Continued)

FOREIGN PATENT DOCUMENTS

EP 0525812 A2 7/1992
GB 1470891 A 4/1977

(Continued)

OTHER PUBLICATIONS

State Intellectual Property Office of People's Republic China, First Search, Application No. 201180073027.8 dated Jun. 15, 2015.

(Continued)

*Primary Examiner* — Minh Truong
(74) *Attorney, Agent, or Firm* — Carlson, Gaskey & Olds

(57) ABSTRACT

An exemplary vertically moveable elevator system component includes a top portion, a bottom portion and a plurality of vertically oriented side portions between the top and bottom portions. At least one of the side portions includes a roller guide support sheet. A first roller guide roller is supported by the sheet such that the first roller is at least partially disposed on a first side of the sheet and an axis of the first roller is generally parallel with the sheet. Second and third rollers are supported by the sheet such that the second and third rollers are on a second, oppositely facing side of the sheet. An axis of each of the second and third rollers is generally perpendicular to the axis of the first roller. The axis of each of the second and third roller remains in a fixed position relative to the sheet.

17 Claims, 4 Drawing Sheets

(58) Field of Classification Search
USPC ..... 29/893.2
IPC ..... B66B 7/04
See application file for complete search history.

(56) References Cited

U.S. PATENT DOCUMENTS

| | | | | |
|---|---|---|---|---|
| 2,069,762 | A * | 2/1937 | Johnson | B21D 51/446 193/45 |
| 2,251,963 | A | 8/1941 | Spiro | |
| 2,253,820 | A | 8/1941 | Spiro | |
| 2,260,922 | A | 10/1941 | Spiro | |
| 3,043,401 | A * | 7/1962 | Hallene | B66B 9/04 187/272 |
| 3,329,240 | A | 7/1967 | Harwood et al. | |
| 3,554,327 | A | 1/1971 | Takamura et al. | |
| 3,905,452 | A * | 9/1975 | Schirmer | B66B 7/1292 104/279 |
| 5,107,963 | A | 4/1992 | Rocca et al. | |
| 5,117,946 | A * | 6/1992 | Traktovenko | B66B 7/046 187/410 |
| 5,331,900 | A | 7/1994 | Gersemsky | |
| 5,355,976 | A | 10/1994 | Goto et al. | |
| 5,544,722 | A | 8/1996 | McKenzie | |
| 5,632,358 | A | 5/1997 | Maeda et al. | |
| 5,866,861 | A * | 2/1999 | Rajamani | B66B 9/00 187/292 |
| 6,006,867 | A | 12/1999 | Richter et al. | |
| 6,050,370 | A | 4/2000 | Jung | |
| 6,345,698 | B1 | 2/2002 | Ravishankar | |
| 2006/0175151 | A1 | 8/2006 | Perez et al. | |
| 2014/0069746 | A1* | 3/2014 | Fargo | B66B 7/046 187/410 |
| 2014/0158473 | A1* | 6/2014 | Arai | B66B 7/046 187/406 |
| 2015/0232301 | A1* | 8/2015 | Sakuma | B66B 7/046 187/410 |
| 2015/0291392 | A1* | 10/2015 | Steiner | B66B 7/046 187/410 |

FOREIGN PATENT DOCUMENTS

| | | | |
|---|---|---|---|
| JP | 48-24423 | | 3/1973 |
| JP | 1231792 | A | 9/1989 |
| JP | 1299181 | A | 12/1989 |
| JP | 5186163 | A | 7/1993 |
| JP | 7144847 | A | 6/1995 |
| JP | 10109857 | | 10/1996 |
| JP | H9-40321 | A | 2/1997 |
| JP | 2000159458 | | 6/2000 |
| JP | 2001139256 | | 5/2001 |
| JP | 2002145554 | | 5/2002 |
| JP | 2002145554 | A | 5/2002 |
| WO | 2005044710 | A1 | 5/2005 |

OTHER PUBLICATIONS

International Preliminary Report on Patentability for International application No. PCT/US2011/048916 dated Mar. 6, 2014.
International Search Report and Written Opinion of the International Searching Authority for International Application No. PCT/US2011/048916 dated Feb. 9, 2012.
State Intellectual Property Office of People's Republic China, Supplementary Search, Application No. 201180073027.8 dated Apr. 28, 2016.
State Intellectual Property Office of People's Republic China, Supplementary Search, Application No. 201180073027.8 dated Nov. 22, 2016.

* cited by examiner

ELEVATOR ROLLER GUIDE

BACKGROUND

Elevator systems include a variety of components to ensure that the system works as intended. Some type of guide arrangement is associated with the elevator car and counterweight to guide movement of the car and counterweight along guiderails. Many elevator guide arrangements include rollers that roll along surfaces on the guiderail as the elevator car moves up and down. Other guide assemblies include sliding elements that slide along surfaces of the guiderail.

There are known reasons for selecting rollers or sliding elements for elevator guides. Sliding guide elements are typically selected for installations that include space constraints because guides including rollers typically occupy more space. Sliding guide elements are sometimes preferred because they typically cost less than roller guides. Guide assemblies including rollers are typically selected for higher speed elevators. Another reason to select roller guides is to provide higher ride quality levels. Roller guides also reduce energy consumption because they have reduced frictional losses compared to sliding guide elements.

Elevator system and component designers have been facing the ongoing challenges of reducing costs of elevator systems and fitting elevator system components within tighter space constraints. In many circumstances, these objectives can be considered incompatible and unattainable without significant innovation.

SUMMARY

An exemplary vertically moveable elevator system component includes a top portion, a bottom portion and a plurality of vertically oriented side portions between the top and bottom portions. At least one of the side portions includes a roller guide support sheet. A first roller guide roller is supported by the sheet such that the first roller is at least partially disposed on a first side of the sheet and an axis of the first roller is generally parallel with the sheet. Second and third rollers are supported by the sheet such that the second and third rollers are on a second, oppositely facing side of the sheet. An axis of each of the second and third rollers is generally perpendicular to the axis of the first roller. The axis of each of the second and third roller remains in a fixed position relative to the sheet.

An exemplary elevator roller guide assembly includes a roller guide support sheet having a mounting hole through the sheet and a support arm projecting from the sheet. A first roller is supported by the support arm at least partially on a first side of the sheet. An axis of the first roller is generally parallel to the sheet. A second roller has a second portion received in the mounting hole so that the portion remains fixed relative to the sheet. A wheel of the second roller is on a second, oppositely facing side of the sheet. The wheel of the second roller is rotatable about an axis that is generally perpendicular to the sheet.

An exemplary elevator cab includes a floor and a ceiling. A plurality of side walls extend between the floor and the ceiling. At least one of the side walls comprises a roller guide support sheet. A first roller guide roller is supported by the sheet such that the first roller is at least partially disposed on a first side of the sheet. An axis of the first roller is generally parallel with the sheet. Second and third roller guide rollers are supported by the sheet such that the second and third rollers are on a second, oppositely facing side of the sheet. An axis of each of the second and third rollers is generally perpendicular to the axis of the first roller.

The various features and advantages of disclosed examples will become apparent to those skilled in the art from the following detailed description. The drawings that accompany the detailed description can be briefly described as follows.

DETAILED DESCRIPTION

Figure 1A:
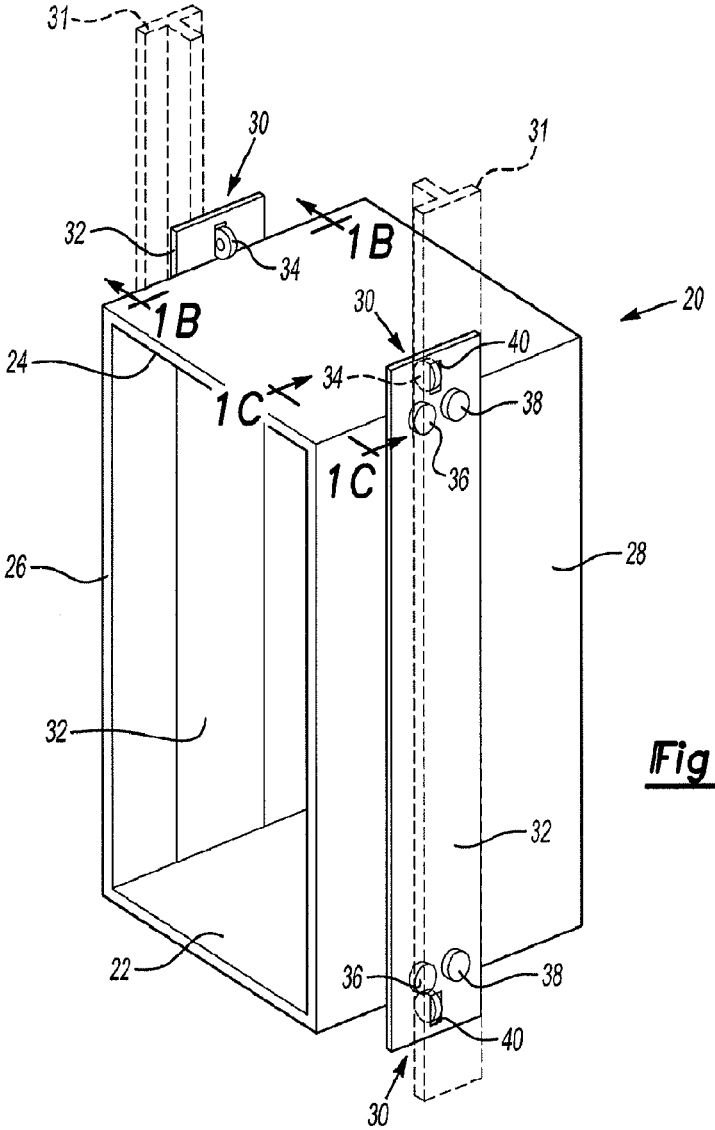
FIG. 1A schematically illustrates selected portions of an elevator cab, including a roller guide assembly designed according to an embodiment of this invention.
Figure 1B:
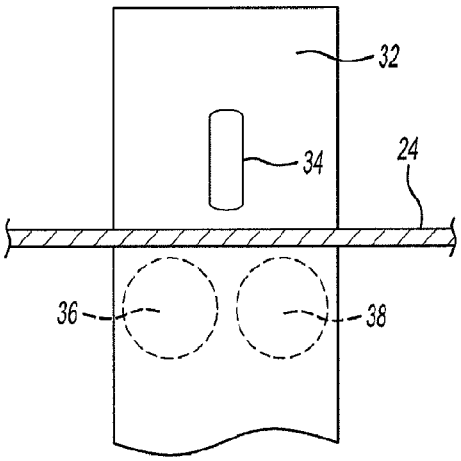
FIG. 1B is a sectional view as shown at B in FIG. 1A showing an example relationship between rollers and a ceiling of the example elevator cab from one view.
Figure 1C:
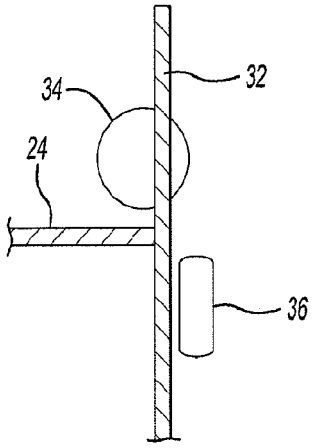
FIG. 1C is a sectional view as shown at C in FIG. 1A showing the example relationship in FIG. 1B from another view.

FIG. 1 schematically shows selected portions of an elevator cab 20. The structure of the cab 20 includes a floor 22, a ceiling 24 and sidewalls 26 and 28. In this frameless car example, each of the sidewalls 26 and 28 of the cab 20 includes at least one sheet 32 that supports a roller guide assembly 30, which is used for guiding movement of the elevator cab 20 along guiderails 31. The sheet 32 could be the vertical upright of the cab 20 and could be formed from by bending and/or folding a steel sheet into a desired shape. The car alternatively could include a frame (not shown) that supports the cab 20 and the sheet 32 could be part of the frame.

The car (framed or frameless) and guiderails 31 can be part of an elevator system that could include (but not shown) a counterweight, roping for suspending and driving the car and/or counterweight, and a machine that drives a traction sheave to move the roping and transport the car and/or counterweight.

The roller guide assemblies 30 each include a first roller 34 that is at least partially on one side of the sheet 32, which establishes a portion of the corresponding sidewall 26 or 28. In this example, the sheet 32 is configured so that a first side establishes an interior of the elevator cab 20 at a corresponding location along the sidewall where the sheet 32 is located. The first roller 34 is disposed at least partially on the first side of the sheet in this example. A second side of the sheet 32 faces outward and establishes an exterior of a corresponding portion of the sidewall of the elevator cab 20.

Each roller guide assembly 30 includes a second roller 36 and a third roller 38 supported by the sheet 32 on the second side of the sheet. The example sheets 32 include openings 40 through which a portion of at least a wheel of each first roller protrudes so that the first roller 34 can follow along a corresponding surface on a guiderail.

One feature of the illustrated example is that the roller guide assemblies are at least partially positioned on the sides of the elevator cab 20 between the cab 20 and the corresponding guiderail 31. This is different than conventional arrangements where roller guide assemblies were mounted completely above or below an elevator cab. For example, the second rollers 36 and the third rollers 38 are at least partially disposed in a vertical position between the floor 22 and the ceiling 24 of the elevator cab 20. Being able to position the roller guide assemblies in this manner provides space savings within an elevator system. The illustrated example allows for using roller guide assemblies that include three rollers without requiring that the entire roller guide assembly be positioned above or below the elevator cab. Most attempts at providing such a position for a guide arrangement required using sliding guide elements instead of rollers because of the space constraints between the sides of an elevator cab and the guiderails. With the illustrated example, the advantages of a three roller, roller guide assembly and space savings can be realized simultaneously.

Figure 2:
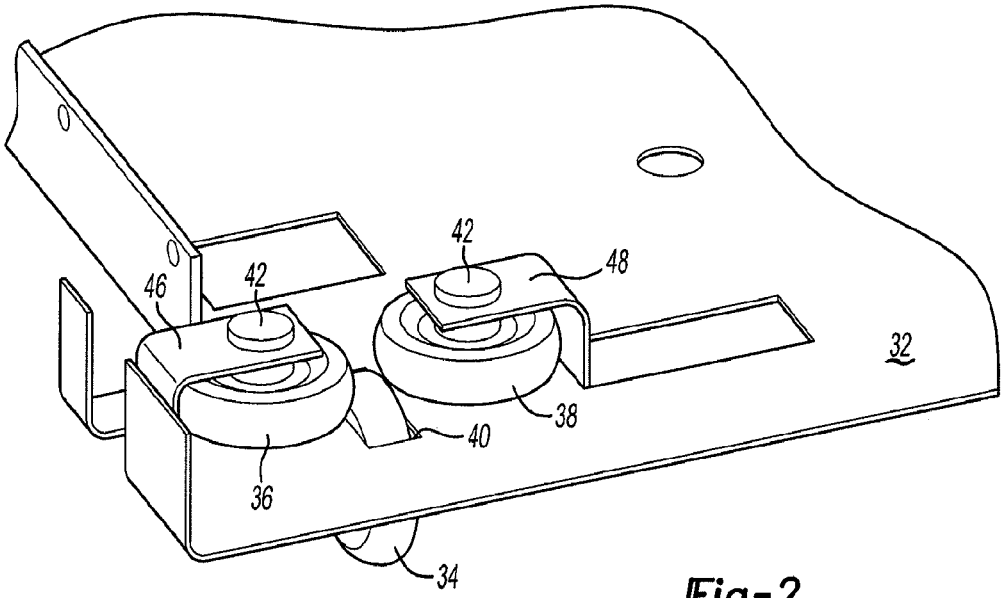
FIG. 2 illustrates an example roller guide assembly configuration from a first perspective.
Figure 3:
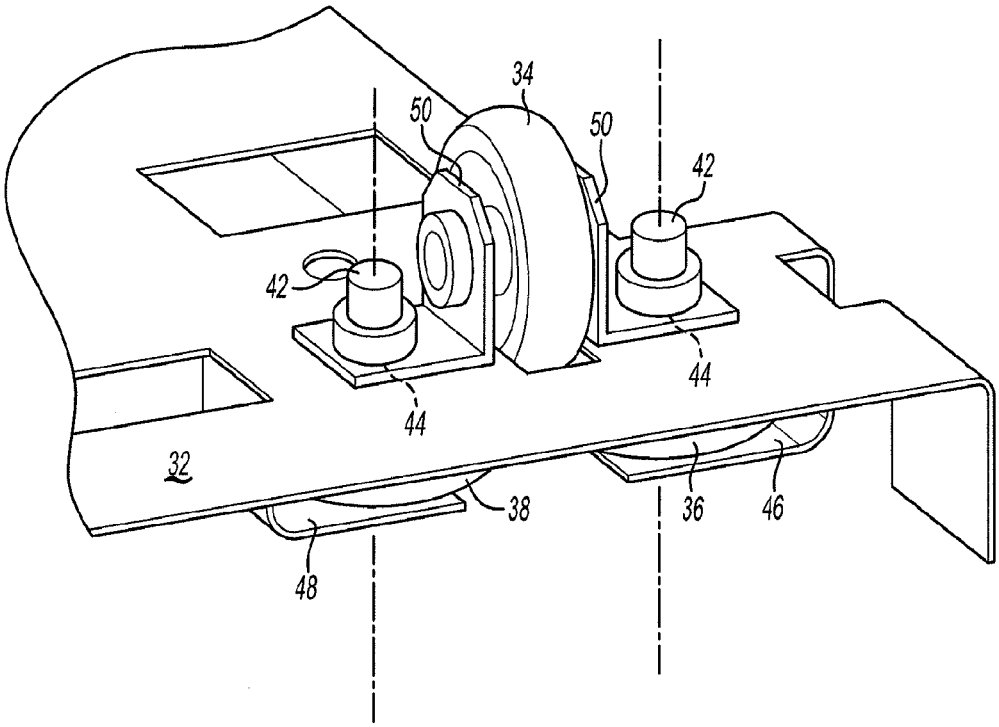
FIG. 3 illustrates the example of FIG. 2 from another perspective.

Referring to FIGS. 2 and 3, one example configuration includes supporting the second roller 36 and the third roller 38 on one side of the sheet 32 by securing mounting members 42 relative to holes 44 established through the sheet 32. In this example, the mounting members 44 are also secured to flanges 46 and 48, respectively. The flanges 46 and 48 in this example are formed from a portion of the sheet 32. As can be appreciated from the illustration, a portion of the sheet 32 is cut or punched and then bent to position the flanges 46 and 48 so that the rollers 36 and 38 are received between the flanges and another portion of the sheet 32.

The first roller 34 is supported by support arms 50 that extend from the first side of the sheet 32, which is opposite to the second side on which the second roller 36 and third roller 38 are disposed. The opening 40 allows a portion of the first roller 34 to protrude past the second side of the sheet 32 so that all three rollers are in a position to engage a corresponding surface on a guiderail 31. In the illustrated example, the support arms 50 comprise pieces that are secured to the sheet 32. Those pieces are supported by the sheet 32 and, therefore, the first roller 34 is considered supported by the sheet 32. In other examples, the support arms 50 are formed from portions of the sheet 32.

The arrangement illustrated in FIGS. 2 and 3 can be positioned near the top and bottom of each of two sides of an elevator cab. Integrating the support for the rollers of the roller guide assembly into the sheet 32, which is a portion of the sidewall of the cab, reduces the number of separate parts that are required in the elevator system. Additionally, cost savings are realized during the installation because there is no need for aligning a separate roller guide assembly with the elevator cab by mounting the entire assembly to the cab. Having the roller guide support structure as an integral part of a sheet of a sidewall of the elevator cab pre-positions the rollers relative to the cab, which streamlines an installation procedure.

Figure 4:
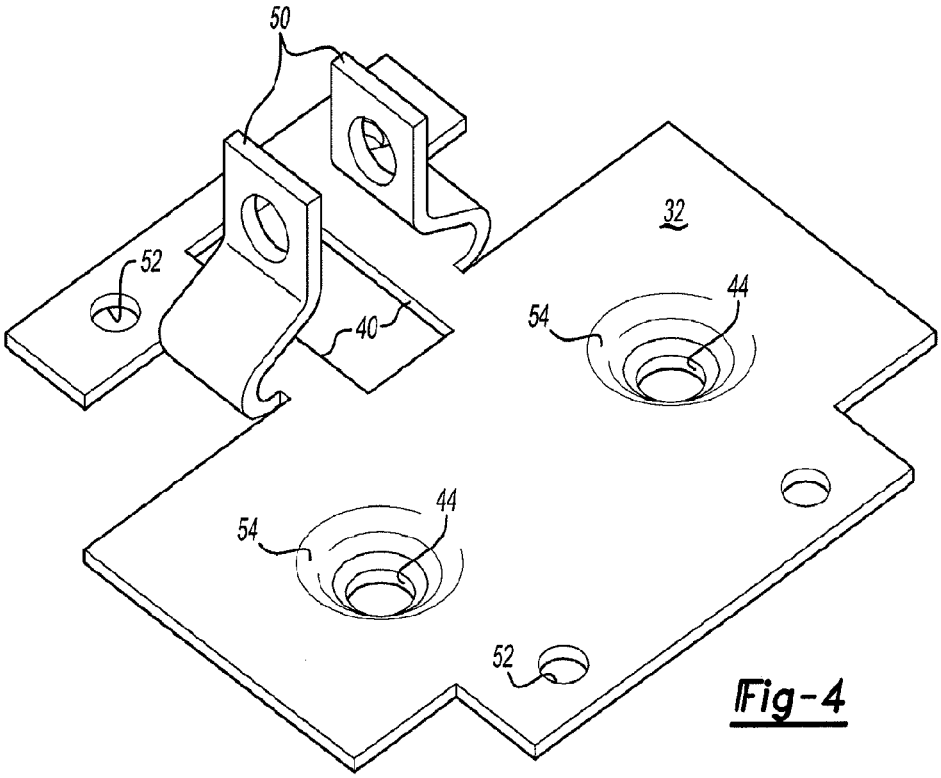
FIG. 4 illustrates a sheet configured for supporting rollers of a roller guide assembly of another example embodiment.

FIG. 4 illustrates another arrangement of a sheet 32 configured for supporting rollers of a roller guide assembly. In one such example, the illustrated sheet 32 is a portion of a larger sheet that is part of the sidewall of the elevator cab. In another example, the illustrated sheet 32 is formed as a separate sheet that can be connected with the sidewall of the elevator cab. The example in FIG. 4 includes mounting holes 52 that are useful for positioning the sheet 32 on a corresponding portion of the sidewall of an elevator cab for purposes of mounting the roller guide assembly to the sidewall of the cab when the illustrated sheet is a separate piece.

Figure 5:
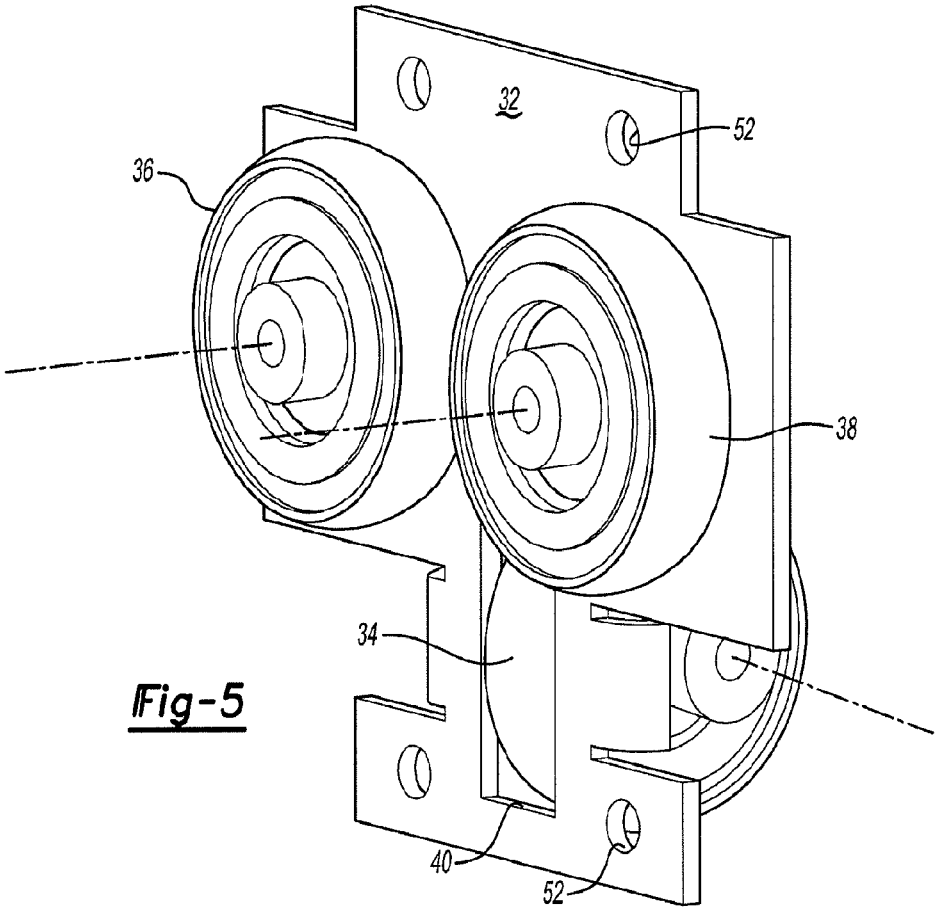
FIG. 5 illustrates a roller guide assembly associated with the example sheet of FIG. 4 from one perspective.
Figure 6:
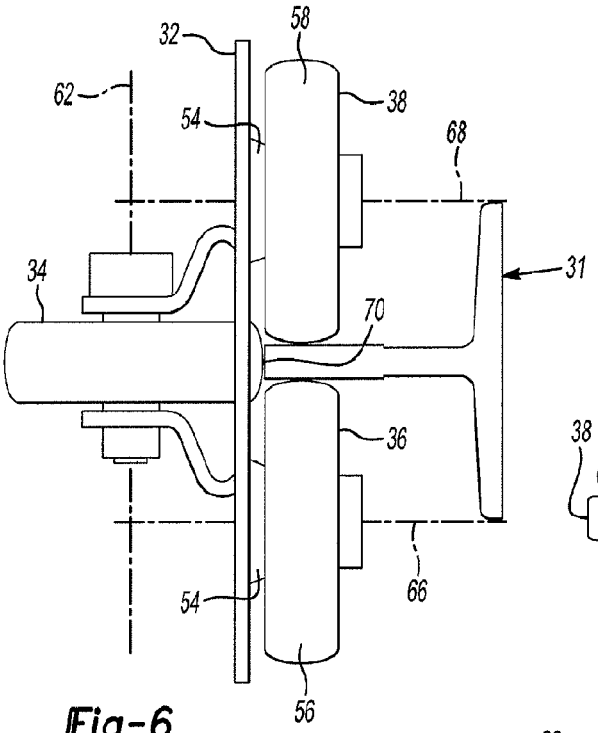
FIG. 6 is an elevational view of the example of FIG. 5 showing the roller guide assembly associated with a guiderail.

FIGS. 5 and 6 show a completed roller guide assembly including the sheet 32 of FIG. 4. The first roller 34 is supported by the support arms 50, which in this example are formed from a bent portion of the sheet 32. As can be appreciated from the illustrations, a portion of the sheet 32 is cut or punched and then bent or otherwise shaped into the configuration shown to establish a support for the first roller 34 on one side of the sheet 32. The second roller 36 and third roller 58 are received on an opposite side of the sheet 32 when a portion of those rollers is received through the mounting holes 44 that are drilled, punched or otherwise established in the sheet 32.

The illustrated example includes a boss 54 near each of the mounting holes 44. The bosses 54 provide spacing between wheel portions 56 and 58 of the rollers 36 and 38, respectively, and the sheet 32. The bosses 54 eliminate the need for providing separate spacer elements between the sheet 32 and the wheel portions 56 and 58 of the rollers. Including boss portions 54 further streamlines the assembly and installation of the roller guide assembly consistent with the illustrated example.

As shown in FIG. 6, the rollers of the roller guide assembly follow along the surfaces on a guiderail 31 as the elevator cab moves vertically. The first roller 34 rotates about an axis 62 that is generally parallel with the plane of the sheet 32. The second roller 36 rotates around an axis 66 and the third roller 38 rotates about an axis 68. The axes 66 and 68 are generally perpendicular to the plane of the sheet 32 and generally perpendicular to the axis 62 of the first roller 34.

As can be appreciated from FIG. 6, a portion of the wheel 70 of the first roller 34 protrudes through the opening 40 (best shown in FIGS. 4 and 5) so that even though a substantial portion of the roller 34 is supported on one side of the plate 32, the wheel portion 70 is able to make contact with a corresponding surface on the guiderail 60, which is disposed on an opposite side of the plate 32.

Figure 7:
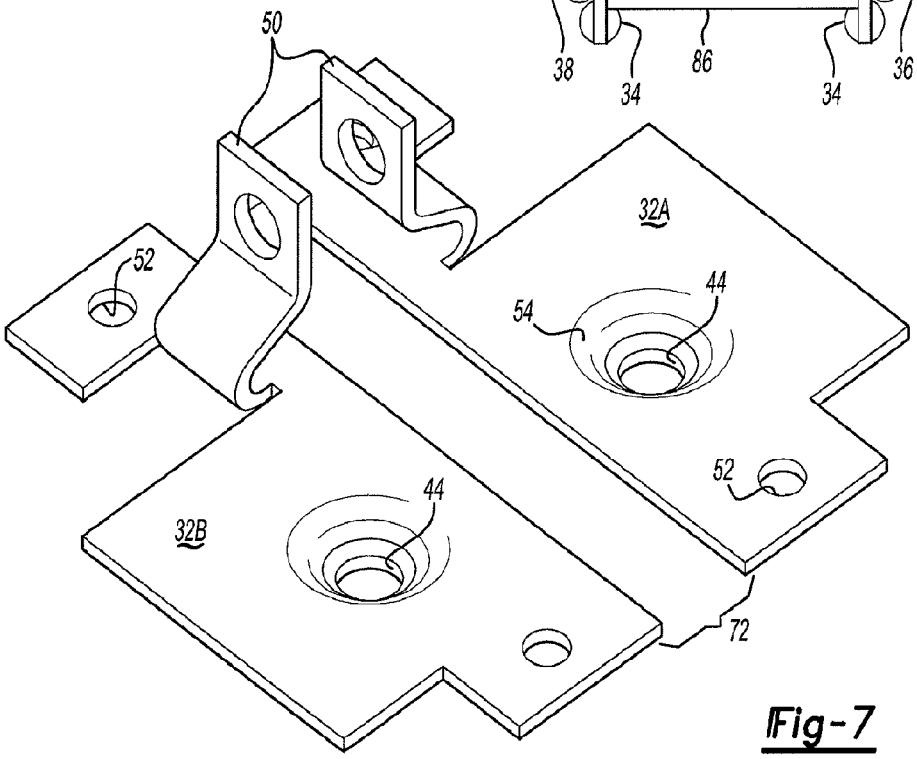
FIG. 7 illustrates selected portions of another example roller guide assembly.

FIG. 7 shows another configuration of a sheet 32 for supporting the roller guide assembly on the side of an elevator cab. In this example, the sheet 32 comprises two sheet portions 32A and 32B. The sheet portion 32A, for example, includes a support arm 50 situated to support a first roller 34 on one side of the sheet 32. A mounting hole 44 is positioned to receive a portion of a second roller 36 on an opposite side of the sheet 32. Similarly, the sheet portion 32B includes a support arm 50 that is also disposed for supporting the first roller 34 on the first side of the sheet 32. A mounting hole 44 is positioned to receive a portion of a third roller 38 so that the third roller is on the second side of the sheet 32.

The example FIG. 7 does not include an opening 40, but instead has a spacing 72 between the two sheet portions 32A and 32B. A portion of the wheel of the first roller 34 protrudes through the spacing 72 for purposes of making contact with a guiderail, which is disposed on the same side of the sheet as the second and third rollers.

The example of FIG. 7 may be used as separate mounting pieces that are secured to the sidewall of an elevator cab. In another example, the configuration of FIG. 7 comprises portions of a larger sheet that establishes at least a portion of the sidewall of the cab.

Figure 8:
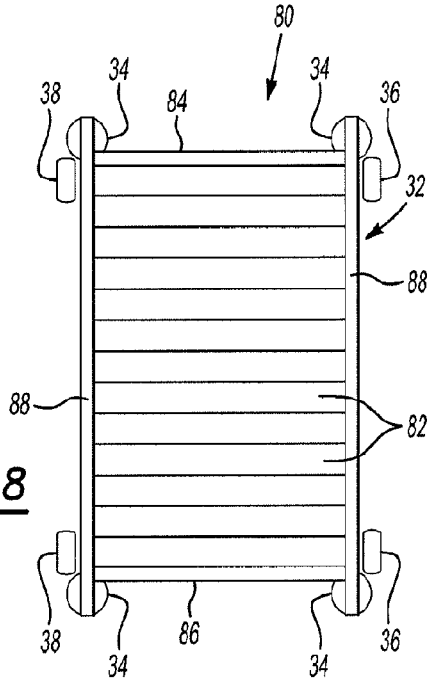
FIG. 8 schematically illustrates selected portions of a counterweight including a roller guide assembly designed according to an embodiment of this invention.

FIG. 8 shows a counterweight 80 having roller guide assemblies 30 like those described above. The counterweight includes weight plates 82 supported by a frame having a top portion 84, a bottom portion 86 and side portions 88. In this example, the side portions 88 of the counterweight 80 include the sheet 32 that provides support for the rollers 34, 36 and 38. In another example, a separate sheet 32 is secured to a side portion 88 of the counterweight 80.

Whether utilized for guiding a cab or counterweight, the example roller guide assemblies allow for having a roller guide support sheet 32 that derives support from the surrounding elevator component structure (e.g., the sidewall or upright of an elevator cab or a side portion of a counterweight). This allows for using a sheet such as the example sheets 32 for the for the roller guide support while minimizing the strength requirements of the sheet, itself. In some examples, the roller guide support sheet is a portion of the elevator component structure.

Various features of different example embodiments have been disclosed. The features of each example are not necessarily exclusive to that example, as various combinations of those features may be realized. Further, different configurations of the structural portions of the sheet used for supporting the rollers may be used on the upper and lower portions of a single elevator cab. Given this description, those skilled in the art will realize what combination of features from the disclosed examples will best meet the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A vertically moveable elevator cab, comprising:

a top portion comprising a ceiling of the cab;

a bottom portion comprising a floor of the cab;

a plurality of vertically oriented portions each respectively comprising a sidewall of the cab, the side portions respectively having a side portion length that is at least as long as a distance between the top and bottom portions, at least one of the side portions comprising a vertically oriented sheet having a vertically extending sheet length at least as long as the side portion length, the sheet establishing a roller guide support;

a first roller at least partially disposed on a first side of the sheet, an axis of the first roller at least partially passing through at least one roller support arm extending away from the first side of the sheet, the axis being generally parallel with another portion of the sheet, wherein the roller support arm is a bent portion of the sheet; and second and third rollers supported by the sheet such that the second and third rollers are on a second, oppositely facing side of the sheet with an axis of each of the second and third rollers generally perpendicular to the axis of the first roller, the axis of each of the second and third rollers always remaining in a single location that is in a fixed position relative to the sheet, wherein the first side of the sheet establishes an interior of at least some of the at least one sidewall and the oppositely facing second side establishes an exterior of at least some of the at least one sidewall.

2. The elevator cab of claim 1, wherein the sheet includes mounting features for securing the second and third rollers on the second side of the sheet.

3. The elevator cab of claim 2, wherein the mounting features comprise mounting holes through the sheet, one of the mounting holes receiving a portion of the second roller and another of the mounting holes receiving a portion of the third roller.

4. The elevator cab of claim 3, wherein the sheet comprises a boss near each of the mounting holes for spacing a wheel portion of a corresponding roller at a desired distance from the second side of the sheet.

5. The elevator cab of claim 2, wherein the sheet comprises an opening between the mounting features and the first roller partially protrudes through the opening such that at least some of a wheel portion of the first roller is exposed on the second side of the sheet.

6. The elevator cab of claim 1, wherein the roller support arm is cantilevered from the first side of the sheet.

7. The elevator cab of claim 1, wherein the at least one side portion comprises flanges spaced from the second side and the second and third rollers are each at least partially received between the second side and a corresponding one of the flanges.

8. The elevator cab of claim 7, wherein the flanges comprise bent portions of the sheet.

9. The elevator cab of claim 1, wherein a second one of the sidewalls on an opposite side of the cab from the one of the sidewalls comprises a second roller guide support sheet;

another first roller is supported by the second sheet at least partially disposed on a first side of the second sheet with an axis generally parallel with the second sheet; and another second roller and another third roller are each supported by the second sheet on a second, oppositely facing side of the second sheet with axes generally perpendicular to the second sheet.

10. The elevator cab of claim 1, wherein the cab includes an interior space having a vertical extent between the ceiling and the floor and wherein the second and third rollers are at least partially disposed at a vertical position that overlaps with the vertical extent of the interior of the cab.

11. The elevator cab of claim 1, comprising a frame that supports the cab and wherein the side portion is an upright of the frame.

12. An elevator cab, comprising:

a floor;

a ceiling;

a plurality of sidewalls each having a height extending between the floor and the ceiling, at least one of the sidewalls at least partially established by a vertically oriented sheet having a vertically extending length at least as long as the height, the sheet establishing a roller guide support;

a first roller guide roller supported by a bent portion of the sheet such that the first roller is at least partially disposed on a first side of the sheet and an axis of the first roller at least partially passes through the bent portion of the sheet and is generally parallel with another portion of the sheet; and second and third roller guide rollers supported by the sheet such that the second and third rollers are on a second, oppositely facing side of the sheet with an axis of each of the second and third rollers generally perpendicular to the axis of the first roller, wherein the axes of the second and third rollers at least partially pass through openings in the sheet; and the openings remain in a single, fixed position relative to the sheet.

13. The elevator cab of claim 12, wherein the sheet comprises a boss for spacing a wheel portion of the second roller at a desired distance from the second side of the sheet.

14. An elevator cab comprising:

a ceiling;

a floor;

a plurality of vertically oriented sidewalls each having a length that is at least as long as a distance between the ceiling and the floor of the cab, at least one of the sidewalls comprising a vertically oriented sheet having a vertically extending sheet length at least as long as the length of the sidewall, a first side of the sheet establishing an interior of at least some of the at least one sidewall and an oppositely facing, second side of the at least one sheet establishing an exterior of at least some of the at least one sidewall, the sheet establishing a roller guide support;

a first roller supported by the sheet such that the first roller is at least partially disposed on the first side of the sheet and an axis of the first roller is generally parallel with the at least one sidewall; and second and third rollers supported by the sheet such that the second and third rollers are on the second side with an axis of each of the second and third rollers generally perpendicular to the at least one sidewall, the axis of each of the second and third rollers being in a single, permanent location relative to the sheet, wherein a bent portion of the sheet establishes at least one roller support arm extending away from the first side of the sheet, the first roller being supported by the roller support arm.

15. The elevator cab of claim 14, wherein the roller support arm is cantilevered from the first side of the sheet.

16. An elevator cab comprising:

a ceiling;

a floor;

a plurality of vertically oriented sidewalls each having a length that is at least as long as a distance between the ceiling and the floor of the cab, at least one of the sidewalls comprising a vertically oriented sheet having a vertically extending sheet length at least as long as the length of the sidewall, a first side of the sheet establishing an interior of at least some of the at least one sidewall and an oppositely facing, second side of the at least one sheet establishing an exterior of at least some of the at least one sidewall, the sheet establishing a roller guide support;

a first roller supported by the sheet such that the first roller is at least partially disposed on a first side of the sheet and an axis of the first roller is generally parallel with the at least one sidewall; and second and third rollers supported by the sheet such that the second and third rollers are on the second side with an axis of each of the second and third rollers generally perpendicular to the at least one sidewall, the axis of each of the second and third rollers being in a single, permanent location relative to the sheet, wherein the sheet includes mounting holes through the sheet;

one of the mounting holes receives a portion of the second roller;

another of the mounting holes receives a portion of the third roller;

there is an opening between the mounting holes; and the first roller partially protrudes through the opening such that at least some of a wheel portion of the first roller is exposed on the second side of the sheet.

17. A vertically moveable elevator system component, comprising:

a top portion;

a bottom portion;

a plurality of vertically oriented side portions each having a side portion length that is at least as long as a distance between the top and bottom portions, at least one of the side portions comprising a vertically oriented sheet having a vertically extending sheet length at least as long as the side portion length, the sheet establishing a roller guide support;

a first roller at least partially disposed on a first side of the sheet, an axis of the first roller at least partially passing through at least one roller support arm extending away from the first side of the sheet, the axis being generally parallel with another portion of the sheet, wherein the roller support arm is a bent portion of the sheet; and second and third rollers supported by the sheet such that the second and third rollers are on a second, oppositely facing side of the sheet with an axis of each of the second and third rollers generally perpendicular to the axis of the first roller, the axis of each of the second and third rollers always remaining in a single location that is in a fixed position relative to the sheet, wherein the bent portion of the sheet comprises two support arms; and the first roller is situated between the two support arms.

* * * * *